United States Patent [19]

Post

[11] 4,109,600

[45] Aug. 29, 1978

[54] PROCESS FOR APPLYING A THREADED SEAT IN A METAL PLATE

[76] Inventor: Willem Pieter Post, Burg.Arriënsweg 7, Diepenveen, Netherlands

[21] Appl. No.: 639,924

[22] Filed: Dec. 11, 1975

[30] Foreign Application Priority Data

Nov. 13, 1975 [NL] Netherlands ..... 7513282

[51] Int. Cl.[2] ..... B21D 51/00

[52] U.S. Cl. ..... 113/121 R; 222/288; 285/221

[58] Field of Search ..... 113/1 D, 1 F, 116 R, 113/116 UT, 121 R, 121 A, 121 AB, 121 C, 121 F; 72/333, 340; 285/201, 204, 203, 206, 221; 220/288; 29/512, 522

[56] References Cited

U.S. PATENT DOCUMENTS

| | | | |
|---|---|---|---|
| 1,591,184 | 7/1926 | Reynolds | 29/512 |
| 1,793,296 | 2/1931 | Wilson | 72/333 |
| 2,254,924 | 9/1941 | Williams | 29/512 |
| 2,332,175 | 10/1943 | Sinclair | 72/333 |
| 2,447,536 | 8/1948 | Robinson | 285/204 X |
| 2,960,954 | 11/1960 | Dearing et al. | 113/121 E |
| 3,076,670 | 2/1963 | Meyer | 220/288 X |
| 3,124,267 | 3/1964 | Celtone | 29/512 |
| 3,412,593 | 11/1968 | Price | 72/340 X |
| 3,466,661 | 9/1969 | Phillips | 220/288 X |

FOREIGN PATENT DOCUMENTS

| | | |
|---|---|---|
| 848,027 | 10/1939 | France. |
| 138,887 | 2/1965 | Netherlands. |
| 6,410,183 | 3/1965 | Netherlands. |

*Primary Examiner*—Leon Gilden
*Attorney, Agent, or Firm*—Bacon & Thomas

[57] ABSTRACT

Process for applying a threaded seat for connecting a closing means or operations means to a metal plate, such as the wall of a drum, by making a hole in the plate and by drawing a cylindrical collar from the periphery around said hole approximately at a right angle to the plane of the plate, whereafter a thread is made in the part drawn from the plane of the plate, wherein a thread is provided in the collar between the plane of the plate and the end edge of the collar.

3 Claims, 12 Drawing Figures

PROCESS FOR APPLYING A THREADED SEAT IN A METAL PLATE

The invention relates to a process for forming a threaded seat for connecting a closing means or operation means to a metal plate, such as the wall of a drum, by first making a hole in the plate and by then drawing a cylindrical collar from the periphery around said hole approximately at a right angle to the plane of the plate, whereafter a thread is made in the part drawn from the plane of the plate.

Such a process is known from U.S. Pat. No. 2,960,954. When the collar is drawn from the periphery of the pre-made hole, a straight cylindrical collar is obtained. The edge of this collar is bent in a wide band inwardly towards the axis and then further back, whereafter the extreme part of the end edge is bent towards the axis again, to form an annulus. Into this extreme part or annulus of the end edge a lead is pressed after the removal of a part of the material in this area. The sharp edge of the annulus thus serves as a thread. The disadvantage of this known method is that the fixation means obtained, that is the annulus thread, is weak. Axial pressure of a closing means and/or operation means in the hole or the exertion of a drawing force thereon, will easily bend the annulus or end edge. Another disadvantage of the seat obtained by this known method is that the annulus thread is sharp. This can damage the thread of the means to be connected to the seat, and injuries to the operator can occur.

In Dutch patent application No. 138 887 a process is described, by which a threaded seat is also formed from the material of the plate. At the spot where the hole is to be made, radially extending slots are provided in the plate, whereafter spiral grooves are provided in the remaining lips, as by pressing. Finally the lips are pressed out of the plane of the plate, the earlier provided grooves forming the thread. Although the fixation means, that is the long thread, is more solid than those of the seat obtained by the above described method, the initially provided slots cause a weakening of the material. Moreover, this seat too has sharp edges with the disadvantages thereof.

As a consequence, none of the seats obtained by both above-described methods have found wide application, especially for making bung holes in drums. The procedure still in common use is that as described in Dutch patent application No. 278 139. A hole with an erect collar is punched in the wall of the drum, an octogonal recess being provided in the plate around the collar. A ring with internal gas thread and a sealing ring are placed into this hole from the inside. The thread ring is provided with an octogonal flange, which is placed in the recess in the plate. Subsequently a supporting ring is placed around the collar. After this assembly operation, the whole is pressed tight by a curling operation under a press.

Of the closing obtained by this method, the cost price of the steel thread ring with sealing and supporting rings is more than 50% of the total price. To this are added two pressing operations and one assembling operation. The assembling operation, especially is difficult to automate and thus requires expensive manpower. As this closing has proved over the years to be a very good one, it is however still widely used in almost the entire world.

It is obvious that making a threaded seat from the material of the wall of the drum itself can provide a considerable economy. As shown by the discussion hereinabove, many efforts have been made to do this, but none has met the desired goals of strength and smooth finishing of the thread. For drums there is the additional requirement that the bung hole must be sealed with a capseal after the insertion of the closing plug. This requirement is not met either by the above-described efforts.

The problem which one faces when applying thread in the collar of the plate material itself is that, especially for a small filling hole with a diameter of say $\frac{3}{4}$ inch, not enough material can be drawn out of the wall of the drum to form the desired bung hole. Drawing away more material means that the wall of the drum will be torn, especially when thin material is used.

The present invention has as its purpose to provide a process by which a threaded seat for connecting a closing means or operation means to a metal plate, as described in the preamble, can be made without the disadvantage involved with holes obtained by the known methods.

This is obtained according to the invention by providing a thread in the collar between the plane of the plate and the end edge of the collar.

In principle, the thread can be provided in any known way. It is preferable, however, to draw the cylindrical collar so that a screwline-formed portion is obtained therein, with the end edge having a continuous annular flange. The end edge is pressed with respect to the axis of the hole in such a way that the central portion of the collar forms in cross-section an angle of less than 90°, whereafter in this area of the collar a single thread is formed by deformation.

The seat obtained in this preferable way provides a true thread directly in the material of the wall of the drum. As the thread is formed in axial direction at a right angle to the pressing plane, this thread can be precision-made to present the required triangular profile of the thread. The thread is located between the wall of the drum and the erect collar. The deformation takes place where the material has not yet suffered from the deformation, so that the risk of tearing is excluded. The thread is thus provided at the strongest part of the bung hole. The shape of the hole is so that no sharp edges or transitions are present or might occur during the operation. Weak spots caused thereby are so avoided.

When drawing the collar with screwline-formed portion it is desirable to provide at the same time a terminal of the thread. For that purpose, in a preferable type of the process according to the invention, a widening is provided to include both the beginning and the end of the screwline formed when the collar is drawn. When the end edge of the collar is thereafter flanged and pressed radially with respect to the axis of the hole, the terminal for the thread is formed automatically at the widening. It is furthermore preferable to provide the beginning of the screwline in the plane of the plate. This has the advantage that more space will be available for a sealing ring at the upper side of the seat.

Because of the fact that the drawing, especially in the preferable types of the process according to the invention, takes place asymmetrically, the hole initially formed by the end edge will have an oval shape. It is for that reason desirable that first a hole is made in the plate with a smaller diameter than eventually desired after the drawing of the collar with the end edge extending itself approximately parallel to the plane of the plate, hole is enlarged. An additional advantage in this method is that starting tension cracks are cut away.

The deformation in the area of the collar portion carrying the single thread can be carried out in dependence of the thread to be formed. In general, a ¾ inch and 2 inch thread is used for drums. The commonly used plugs with rubber sealing ring then fit in these bung holes. Also taps and pumps for the easy emptying of the drum fit therein. The deformation operation can be chosen in dependence on the thickness of the plate material. In case of thin plate material, in a preferable type of the process according to the invention, a single thread is formed in the area of the stage by bending until the stage with that end of the collar, which extends itself towards the end edge, in the transition therebetween forms in cross-section an angle that corresponds to the thread desired. By accurate bending of the thin plate material the correct shape can be given to the lead. In another preferable type of the process according to the invention, in case of thick plate material, a single thread is formed in the area of the stage by pressing until the stage with that part of the collar, which extends itself towards the end edge, in the transition therebetween forms in cross-section an angle that corresponds to the thread desired. In this type, the thread is given the correct shape by pressing the material at the respective place.

For carrying out the process according to the invention, use is preferably made of a device, which is characterized by a press provided with a cylindrical die with screwline-formed stage, and a press provided with a die and matrix of such a shape that when inserted into the hole as from the collar, the subsequent deformations are exerted on the collar. With such a press, a hole in a metal plate, especially a bung hole in a drum, is carried out in only two phases.

The main advantage of the seat obtained by the process according to the invention, is that the main shape of the seat is similar to the main shape of the seat as is commonly used at present and as is described in Dutch patent application No. 278,139. The seat with closing plug can be provided in the usual way with a capseal, without special measures or equipment being necessary therefore.

The invention will be explained hereinafter with reference to the drawing, in which FIG. 1 shows a top view of the seat obtained, FIG. 2 shows a cross-section of the seat, FIG. 3 shows a cross-section of the seat provided with the usual closing plug, FIG. 4 shows in detail a cross-section of an embodiment of the seat, FIG. 5 shows in detail a cross-section of another embodiment the seat, and FIGS. 6*a* through 6*d* show in sequence the first steps in the formation of a seat according to the invention;

Figure 1:
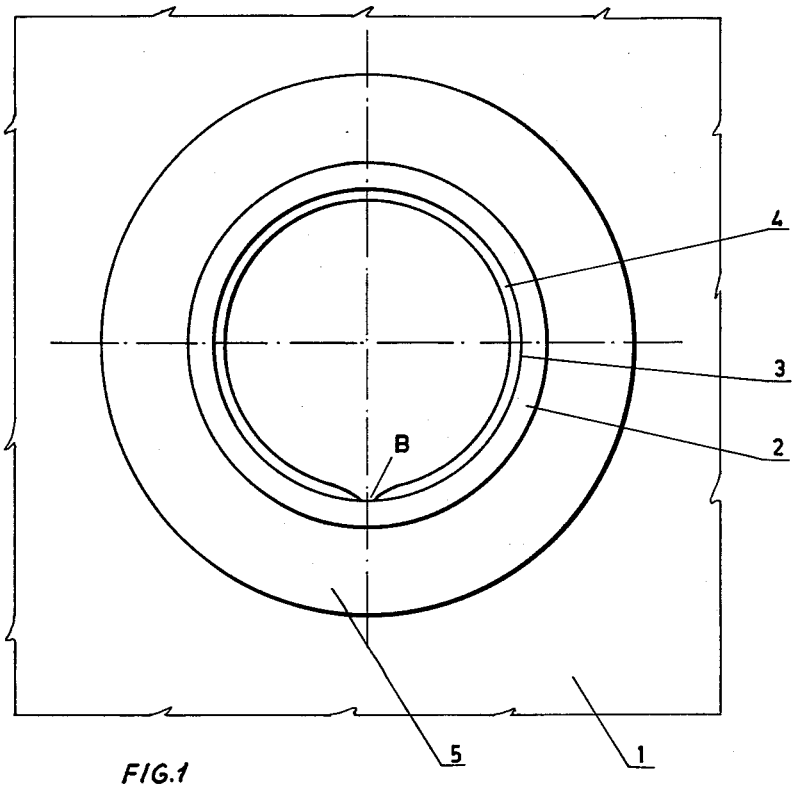
Figure 2:
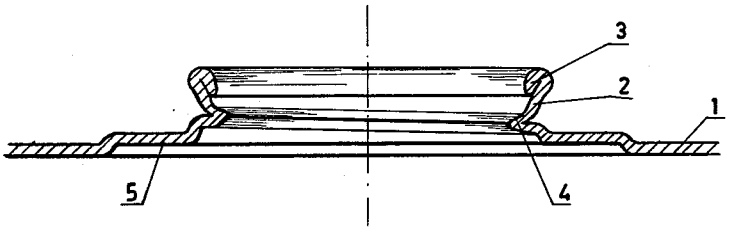
Figure 3:
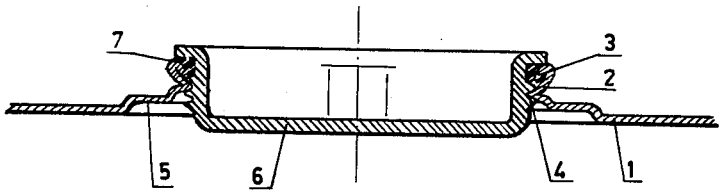

Referring now to FIGS. 1-3, according to the process of the invention, a seat is provided in the plate 1, which consists of a specially shaped collar 2. The collar 2 has a continuous inturned flange at the end edge 3, so that this flanged edge provides a good sealing with the sealing ring of the closing means or of the means to be connected. In the erect collar, a thread 4 is formed by bending or pressing in that part which was not submitted to a deformation when the collar was formed. In the transition of the plate 1 and the collar 2, a higher part 5 can be pressed, which provides a local annular reinforcement around the hole and on which possible indications can be pressed.

FIG. 3 shows how a threaded plug is screwed in the hole and provides a good sealing.

Figure 4:
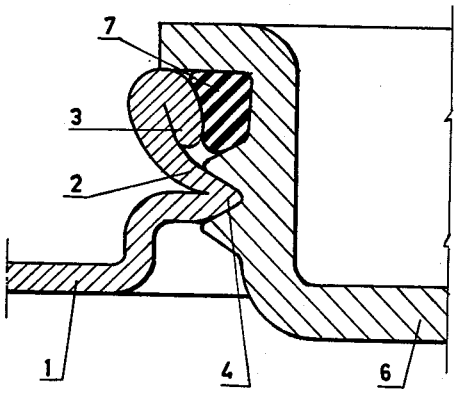
Figure 5:
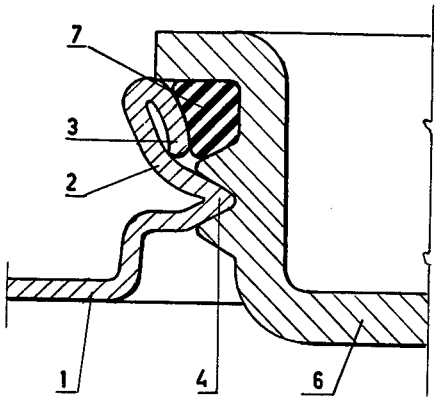

FIG. 4 shows the shape of the collar 2 for thick plate material. This Figure shows clearly that the thread 4 is obtained at that spot by pressing. FIG. 5 shows a similar detail, but now for thin material. In this case, the thread 4 is obtained at that spot by bending. In this case the end edge 3 is flanged less sharply in order to obtain a good sealing surface with the sealing ring 7 of the closing plug 6.

Figure 6B:
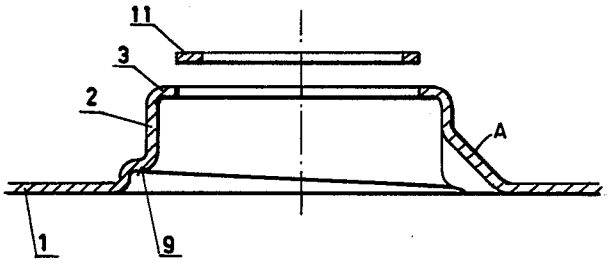
Figure 6C:
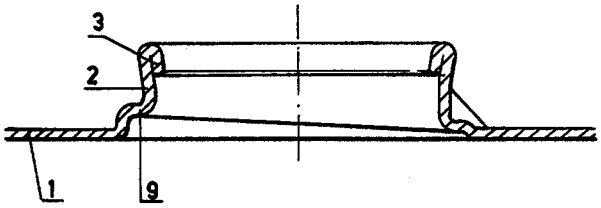
Figure 6D:
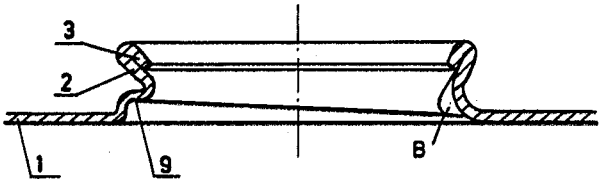
Figure 6A:
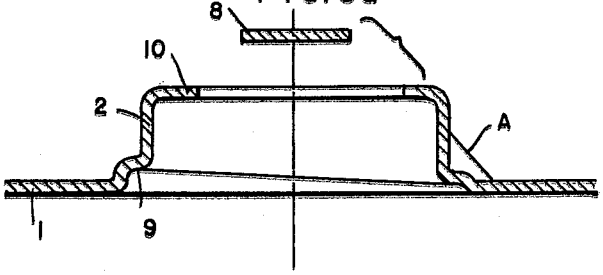

FIGS. 6*a* through 6*d* and FIG. 9 schematically show step by step the process according to the invention. FIG. 6*a* shows the first step of the process according to the invention. In this step, a disc 8 is first punched out of the plate 1, immediately followed by the drawing of the collar 2. In this operation, a screwline-formed stage 9 is also drawn, which as shown in FIG. 6*a* begins in the plane of the plate 1 and extends upwardly over a minor portion of the height of the collar 2. At the upper side of the collar 2, the end edge forms an annular disc 10, and such is still parallel to the plate 1. As a result of the formation of the screwline-formed stage 9, the initially circular hole formed in the annular disc 10 by removal of the disc 8 is drawn slightly oval. In this step of the process according to the invention, a local widening A at the base of the collar 2 is also formed, to provide the terminal of the thread, and as shown in FIG. 7 it is of sufficient height and width to include both the beginning and the end of the single screwline thread 9.

Figure 7:
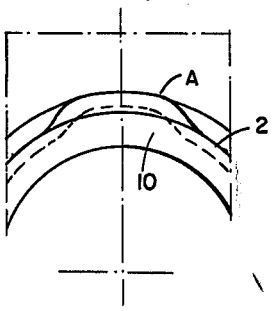
FIG. 7 is a fragmentary plan view of the collar as shown in FIGS. 6*a* and 6*b*, showing the widening formed to include both the initiation and the terminal of the screwline.

In the next step, the oval hole in the annular disc 10 is cut round by a cutting operation as shown in FIG. 6*b*, wherein a ring 11 is removed. By removing this edge area or ring 11, any cracks about the original hole made by removing the disc 8 occurring as a result of the drawing of the collar 2 are removed from the seat.

Through this point in the method the successive operations can be made with one single press, provided with a die with screw-line-formed stage. This means that the described two steps take place immediately after each other in one single operation.

Figure 8:
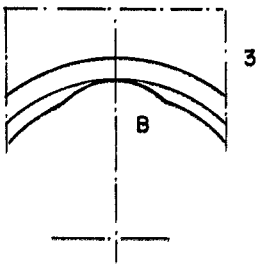
FIG. 8 is a fragmentary plan view of the collar as shown in FIG. 6*d*, showing the widening as it appears after the thread has been formed in the wall of the collar.

In the next step, shown in FIG. 6*c*, the annular disc 10 is turned inwardly to form the continuous flange 3. Immediately thereafter, in the step shown in FIG. 6*d*, this flanged end edge is brought outwards to form a tapered opening. This operation creates in the widening A the terminal B for the thread, as shown in FIGS. 6*d* and 8.

Figure 9:
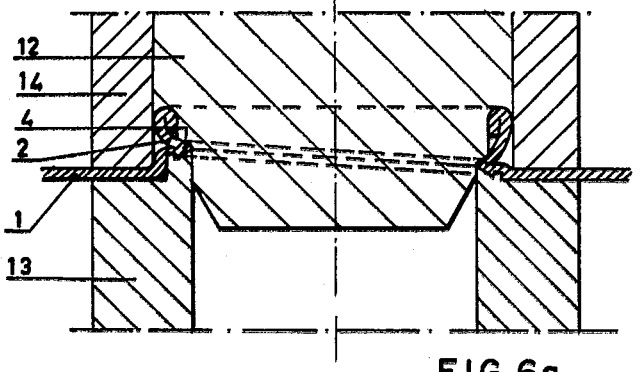
FIG. 9 is a sectional view showing the final step in the formation of the seat, and in particular showing the die, the matrix and the confining ring utilized in a conventional press for the final steps of the method.

Finally, the thread is pressed into the correct profile, as is shown in FIG. 9, by pressing on the ends of the collar 2 while combining the exterior thereof.

The last three steps also take place immediately after each other, by means of a conventional press (not shown) fitted with a die 12 and a matrix 13, in the usual manner. During the pressing the collar 2 is supported and confined at its outside by a ring 14, so that the material of the collar 2 is not pressed away during pressing. The shape of the die 12 shows that the steps of FIGS. 6*c* through FIG. 9 can be carried out in sequence, and FIG. 9 shows the relative positions of the die 12, the matrix 13 and the ring 14 at the end of the steps of the method.

Although the invention has been described mainly for its application for providing a bung hole in the wall of a drum, it will be obvious that the invention is not restricted thereto. Furthermore, modifications in the process and in the device for carrying out this process can be applied without leaving the scope of the invention.

I claim:

1. A process for providing an internally threaded seat on a metal plate, such as the wall of a drum, comprising the steps of:

making a hole in the plate;

drawing a generally cylindrical collar from the plate periphery around said hole approximately at a right angle to the plane of the plate, said cylindrical collar having at the conclusion of said drawing step an internally directed annular disc at the outer end thereof and a single screwline formed in its base by said drawing step and extending upwardly from a beginning point in the plane of said plate over the lower portion of the height of said collar, said drawing further providing a widening at the base of said collar in the area of said beginning point and of sufficient width and height to include both the beginning and the end of said single screwline;

bending said annular disc inwardly to form a continuous flange about the outer end of said collar; and pressing axially on the opposite ends of said collar whereby the portion thereof between said continuous flange and said plate carrying said formed single screwline is deformed inwardly to form a thread.

2. A process as recited in claim 1, wherein said hole is initially cut circular, but becomes oval as a result of said drawing step, and including additionally before said bending step:

cutting an annular ring from said annular disc, to give said annular disc a circular inner periphery.

3. A process as recited in claim 1, wherein said pressing step includes:

positioning said plate peripheral portion at the base of said collar on a matrix, the upper edge of said matrix having a threadform thereon corresponding to said screwline;

positioning an encircling ring about said collar to effect confinement thereof; and passing a die downwardly within said ring to engage the upper face of said collar and press such toward said matrix.

* * * * *